United States Patent [19]

Sedam

[11] Patent Number: 4,497,348

[45] Date of Patent: Feb. 5, 1985

[54] APPARATUS AND METHOD FOR LOADING SYRUP AND $CO_2$ CONTAINERS INTO A PORTABLE POST-MIX BEVERAGE DISPENSER UNIT

[75] Inventor: Jason K. Sedam, Dunwoody, Ga.

[73] Assignee: The Coca-Cola Company, Atlanta, Ga.

[21] Appl. No.: 634,044

[22] Filed: Jul. 24, 1984

Related U.S. Application Data

[63] Continuation of Ser. No. 320,476, Nov. 12, 1981, , which is a continuation-in-part of Ser. No. 277,806, Jun. 26, 1981, Pat. No. 4,357,284.

[51] Int. Cl.[3] ..... B65B 3/04; B01F 3/04

[52] U.S. Cl. ..... 141/2; 99/275; 99/323.1; 137/44; 222/162; 261/121 R; 261/64 B; 261/DIG. 7

[58] Field of Search ..... 222/129.1, 129.2, 129.3, 222/129.4, 181, 185, 162, 509, 518; 261/121 R, 64 R, 64 B, DIG. 7; 99/323.1, 275; 137/109, 38, 44; 426/474, 477; 251/339; 141/1, 364, 2, 18

[56] References Cited

U.S. PATENT DOCUMENTS

| | | | |
|---|---|---|---|
| 967,286 | 8/1910 | Young | 261/DIG. 7 |
| 1,243,068 | 10/1917 | Humphrey | 261/DIG. 7 |
| 1,655,816 | 1/1928 | Josephson | 261/121 R |
| 2,160,501 | 5/1939 | Hedges et al. | 261/DIG. 7 |
| 2,805,846 | 9/1957 | Dewan | 261/121 R |
| 3,003,325 | 10/1961 | Poethig et al. | 137/109 |
| 3,052,377 | 9/1962 | Bill | 261/DIG. 7 |
| 3,081,004 | 3/1963 | Laughlin et al. | 222/162 |
| 3,225,965 | 12/1965 | Jacobs et al. | 261/DIG. 7 |
| 3,351,239 | 11/1967 | Flock | 222/162 |
| 3,572,550 | 3/1971 | Colomina et al. | 261/DIG. 7 |
| 3,933,275 | 1/1976 | Metzner et al. | 222/181 |
| 3,967,633 | 7/1976 | Hallanger et al. | 137/44 |
| 4,093,681 | 6/1978 | Castillo et al. | 261/DIG. 7 |
| 4,161,265 | 7/1979 | Hauser et al. | 222/181 |
| 4,216,885 | 8/1980 | Sedam | 261/121 R |
| 4,222,972 | 9/1980 | Caldwell | 261/121 R |
| 4,306,667 | 12/1981 | Sedam | 261/121 R |
| 4,357,284 | 11/1982 | Sedam | 261/121 R |

FOREIGN PATENT DOCUMENTS

| | | | |
|---|---|---|---|
| 997386 | 9/1951 | France | 222/181 |
| 76183 | 4/1918 | Switzerland | 222/181 |
| 1076987 | 7/1967 | United Kingdom | 222/181 |
| 2072274 | 9/1981 | United Kingdom | 222/181 |

*Primary Examiner*—Houston S. Bell, Jr.

*Attorney, Agent, or Firm*—Birch, Stewart, Kolasch & Birch

[57] ABSTRACT

A lightweight, portable post-mix carbonated beverage dispenser unit for use in small offices or small-volume locations is described. Flavored syrup is supplied to the unit from disposable sealed syrup packages which are plugged into a dispenser valving system. $CO_2$ is supplied to the unit carbonator system in returnable containers which also may be quickly plugged into a $CO_2$ valving system.

9 Claims, 4 Drawing Figures

APPARATUS AND METHOD FOR LOADING SYRUP AND $CO_2$ CONTAINERS INTO A PORTABLE POST-MIX BEVERAGE DISPENSER UNIT

This application is a continuation of Ser. No. 320,476, filed Nov. 12, 1981, which is a continuation-in-part of Ser. No. 277,806, filed June 26, 1981, which is now U.S. Pat. No. 4,357,284.

BACKGROUND OF THE INVENTION

The present invention relates to post-mix beverage dispensers which are compact, portable and suitable for use in small offices or small volume locations. More specifically, the present invention relates to a compact post-mix beverage dispenser unit which may be disposed on a counter top in the above-mentioned environments and supplied with water from a pitcher, syrup from disposable sealed packages and $CO_2$ for carbonation from refillable containers in a rapid and efficient manner. An accessory attachment may allow connection to a building water supply for automatic refill of the reservoir.

Heretofore, the majority of commercially-available post-mix beverage dispenser units have been designed for large volume commercial uses such as in fast food restaurants. Because of these large volume uses, design criteria have emphasized optimum cooling and dispenser speed rather than low unit cost, size and portability. Although some consideration has been given to cost, size and portability even in these large volume commercial units, the resulting unit designs are generally far too expensive, bulky and heavy for small volume use.

Some attempts have been made in the beverage dispenser industry to reduce the cost, size and weight of these units to make them available for use by the general public. However, the units designed heretofore have lacked sufficient cooling capacity, dispensing efficiency, beverage quality and reliability as a trade off to achieving the aforementioned low cost, size and portability needed for consumer acceptance.

In order to be accepted by the small volume consumer, post-mix dispenser units must be easy to set up for use, compact, lightweight, easily repaired, reliable and, most importantly, inexpensive. In addition, the syrup, water and $CO_2$ supplies must be quickly and easily replenished during use by an unskilled consumer. Although attempts have been made to design post-mix beverage dispenser units possessing the foregoing criteria, the design of such a unit has not been totally achieved prior to the invention described hereinafter.

SUMMARY OF THE INVENTION

Accordingly, it is a primary object of the present invention to provide a portable, low cost, miniature post-mix beverage dispenser unit suitable for use in small offices or low volume locations.

It is a further object of the present invention to provide a post-mix beverage dispenser unit with cabinetry features which facilitate rapid set-up, loading and replenishing of the syrup, water and $CO_2$ to be used in making the beverages.

The objects of the present invention are fulfilled by providing a post-mix beverage dispenser unit comprising: a post-mix beverage dispenser system having a water supply, a carbonator tank, at least one syrup container, a $CO_2$ pressure regulator valve assembly and a beverage dispenser valve assembly, the improvement comprising first socket means in said $CO_2$ pressure regulator valve assembly for receiving and supporting the discharge end of said $CO_2$ cylinder, said discharge end being at the bottom of said container when said container is disposed in said first socket means; and second socket means in said beverage dispenser valve assembly for receiving and supporting a discharge end of said syrup container, said discharge end of said syrup container being at the bottom of said container when said container is disposed in said second socket means, whereby said at least one syrup container and said at least one $CO_2$ cylinder can be rapidly plugged into said first and second socket means.

The dispenser unit in a preferred embodiment is adapted for rapid set-up by providing a unique cabinet construction comprising: a main cabinet portion having front, back, side and bottom walls with open compartments formed therein for housing various components of the post-mix beverage dispenser, said compartments including a water supply compartment for housing a water reservoir adjacent said back wall and an entrance chute therefor adjacent said front wall, a carbonator compartment for housing a carbonator tank adjacent said back wall, a syrup supply compartment for for housing replaceable syrup containers adjacent said front wall, and a $CO_2$ cylinder adjacent said front wall; said top wall of said main cabinet having openings therein providing access to said water reservoir, entrance chute, carbonator compartment, and said syrup supply compartment; said front wall having openings therein providing access to said syrup supply compartment and said $CO_2$ supply compartment; first access panel means normally covering the openings in said top wall providing access to both said entrance chute of said water compartment and said syrup compartment, and the opening in said front wall providing access to said syrup supply compartment, said first access panel means being movable to selectively uncover said entrance chute and said syrup supply compartment; a second removable access panel normally covering said openings in said top wall providing access to said water compartment and said carbonator compartment; and a third access panel means normally covering the opening in said front wall providing access to said $CO_2$ supply compartment, said third access panel means being movable to uncover said opening in said front wall to provide access to said $CO_2$ supply compartment.

As an alternative, an accessory attachment may allow connection to a building water supply for automatic refill of the reservoir.

BRIEF DESCRIPTION OF THE DRAWINGS

The objects of the present invention and the attendant advantages thereof become more readily apparent by reference to the accompanying drawings, wherein.

DETAILED DESCRIPTION OF THE PREFERRED EMBODIMENTS

Cabinetry Construction and General Component Arrangement

Figure 1:
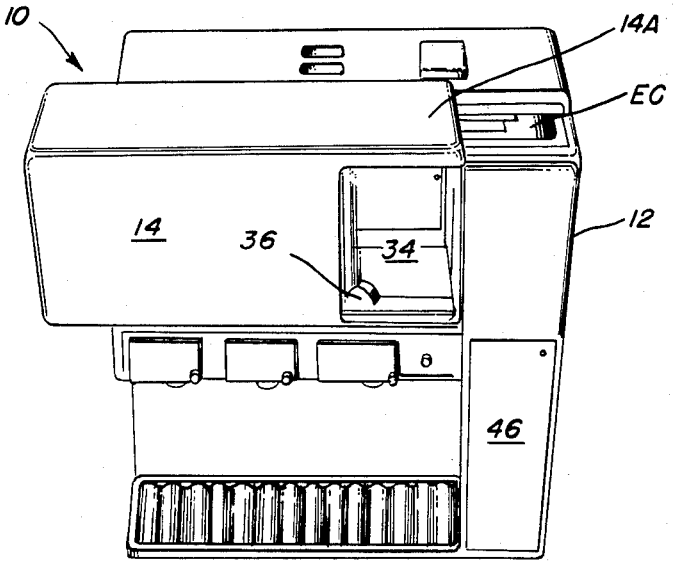
FIG. 1 is a front perspective view showing a front access panel of the cabinet of the dispenser unit of of the present invention in an open position to expose the water entrance chute and syrup supply compartment;.
Figure 2:
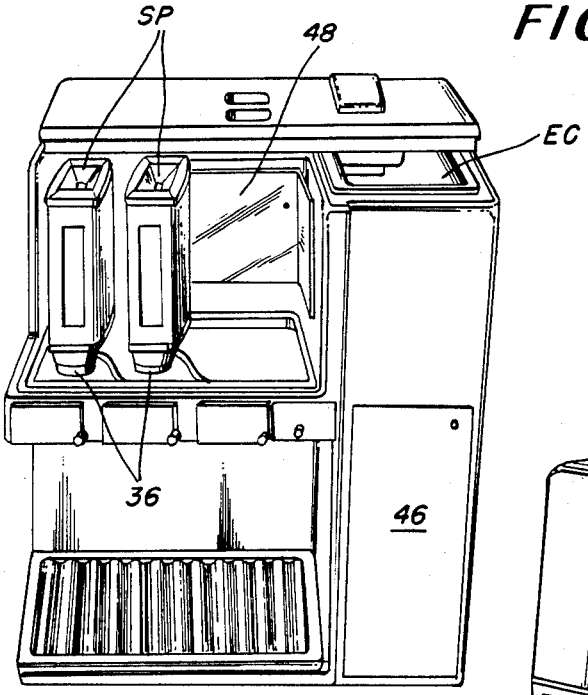
FIG. 2 is a front perspective view with the front access panel completely removed illustrating how syrup containers are plugged into the syrup supply compartment of the present invention.
Figure 3:
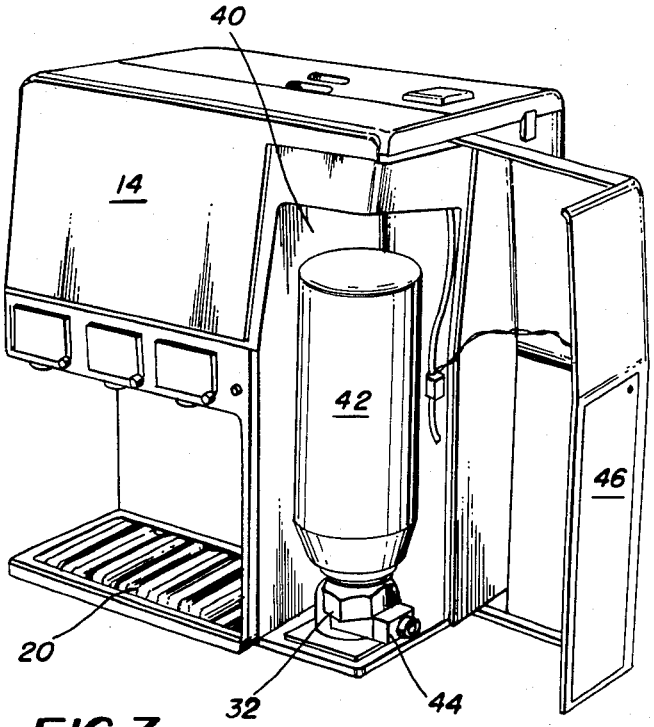
FIG. 3 is a front perspective view illustrating the $CO_2$ supply compartment of the dispenser cabinet of of the present invention in an open position illustrating how $CO_2$ cylinders may be plugged into the $CO_2$ supply compartment.

The cabinetry construction and the general arrangement of the components of the post-mix beverage dispenser unit of the present invention are illustrated in FIGS. 1 to 3. Referring to detail to these Figures, there is illustrated the post-mix beverage unit of the present invention generally designated 10, including a main cabinet portion 12 having front, back, side, top and bottom walls disposed at right angles to each other to provide a generally cubicle shape. A front access panel 14 is slidably mounted on the main cabinet portion 12 in suitable tracks to provide selective access to a water entrance chute EC and a syrup supply compartment 34. The front access panel 14 is so configured that it forms a flush corner of the final cabinet design in its closed position. That is, removable panel 14 has major surfaces parallel to the top, front and left side of the main cabinet portion 12 so that it wraps around and defines a corner of the overall cabinet surface of the unit in the closed position. The front panel 14 is provided with an extension surface 14*a* in the plane of the top wall of the main cabinet 12 which covers water entrance chute EC in the closed position and may be selectively removed to uncover the entrance chute EC in an open position. In this position illustrated in FIG. 1 an associated water reservoir can be manually filled with water from a pitcher by pouring water into entrance chute EC. However, it is advantageous to close off entrance chute EC from the atmosphere when water is not being introduced into the unit for sanitary reasons.

An additional access panel 46 is provided in the lower right-hand corner of the dispenser unit of the present invention, as viewed in FIGS. 1 to 3. In the closed position, panel 46 comprises the lower right-hand corner of the dispenser unit cabinet and is hinged at its back edge to, in effect, form a door which provides access to a $CO_2$ compartment 40 for containing a $CO_2$ cylinder 42 and a $CO_2$ regulator valve assembly 44. That is, access panel 46 has a right angle configuration which conforms to the shape of the lower right-hand corner of the dispenser cabinet to close the $CO_2$ supply compartment which is a cut-out in one corner of cabinet 12.

The unique combination of the access panels 14 and 46 facilitates rapid set-up of the post-mix beverage system of the present invention and easy access for repair. With respect to set-up of the system, this may be achieved in the following manner. Front access panel 14 may be slid to a fully opened position, as illustrated in FIG. 2, and suitable syrup containers SP may be inverted, directing their discharge ends downwardly and plugged into sockets 36. Water may then be manually poured from a pitcher into water entrance chute EC whereby it flows down the chute into water reservoir WR. Front access panel 14 may then be closed to the fully closed position illustrated in FIG. 1. In the event that the dispenser unit had an adequate supply of syrup and only water need be added, the access panel 14 could be slid to the partially open position of FIG. 1, whereby only water entrance chute EC were exposed and water added as described above. The $CO_2$ cylinder 42 illustrated in FIG. 3 may then be added by inverting the $CO_2$ cylinder to direct the discharge opening downwardly and plugging the same into a socket 32 provided in the top surface of $CO_2$ regulator valve assembly 44. Thus, it can be seen that the necessary ingredients to be supplied to the post-mix beverage dispenser can be supplied in a rapid and efficient manner without cumbersome connections by virtue of the unique cabinetry design of the present invention and the plug-in nature of both the syrup packages SP and $CO_2$ cylinder 42 of the present invention.

In further reference to the plug-in nature of the syrup packages SP and the $CO_2$ supply cylinder 42, the specific structure of the valve assemblies and associated containers to be used with the dispenser unit of the present invention are described in prior co-pending applications assigned to the same assignee as the present invention. For example, the specific dispensing valve assembly 18 and mixing nozzles 20 contemplated for use with the present invention are described in prior co-pending application Ser. No. 084,434 filed Oct. 12, 1979 to Jason K. Sedam and William R. Fuerst which is now U.S. Pat. No. 4,306,667. The specific socket for the valve assembly 18 contemplated for use with the present invention is described in applicant's co-pending allowed application Ser. No. 311,645, filed Oct. 15, 1981 to Jason K. Sedam which is now U.S. Pat. No. 4,426,019. The specific $CO_2$ cylinder construction to be used for cylinder 42 and the associated $CO_2$ regulator valve socket and assembly to be used with the dispenser unit of the present invention is described in applicant's co-pending parent application Ser. No. 277,806, filed June 26, 1981 to Jason K. Sedam which is now U.S. Pat. No. 4,357,284. The disclosures of each of these aforementioned co-pending applications are incorporated herein by reference.

The preferred embodiments of the syrup packages SP to be utilized with the present invention are described in U.S. Pat. No. 4,216,885 to Jason K. Sedam, issued Aug. 12, 1980, and the particular shape of the package is disclosed in co-pending design application, Ser. No. 310,367, filed Oct. 9, 1981 to Jason K. Sedam and Simon J. Richter which is now U.S. Pat. Des. 273,768, issued May 8, 1984. As disclosed in the prior Sedam U.S. Pat. No. 4,216,885, the syrup package SP is provided with a flow control tube therein which is vented to the atmosphere through the bottom of the container after the container is plugged into socket 36. Containers SP are also provided with frangible seals or membranes over the discharge openings thereof and are punctured by a knife or cutting means of the type described in the co-pending application, Ser. No. 311,645, mentioned above now U.S. Pat. No. 4,426,019.

Figure 4:
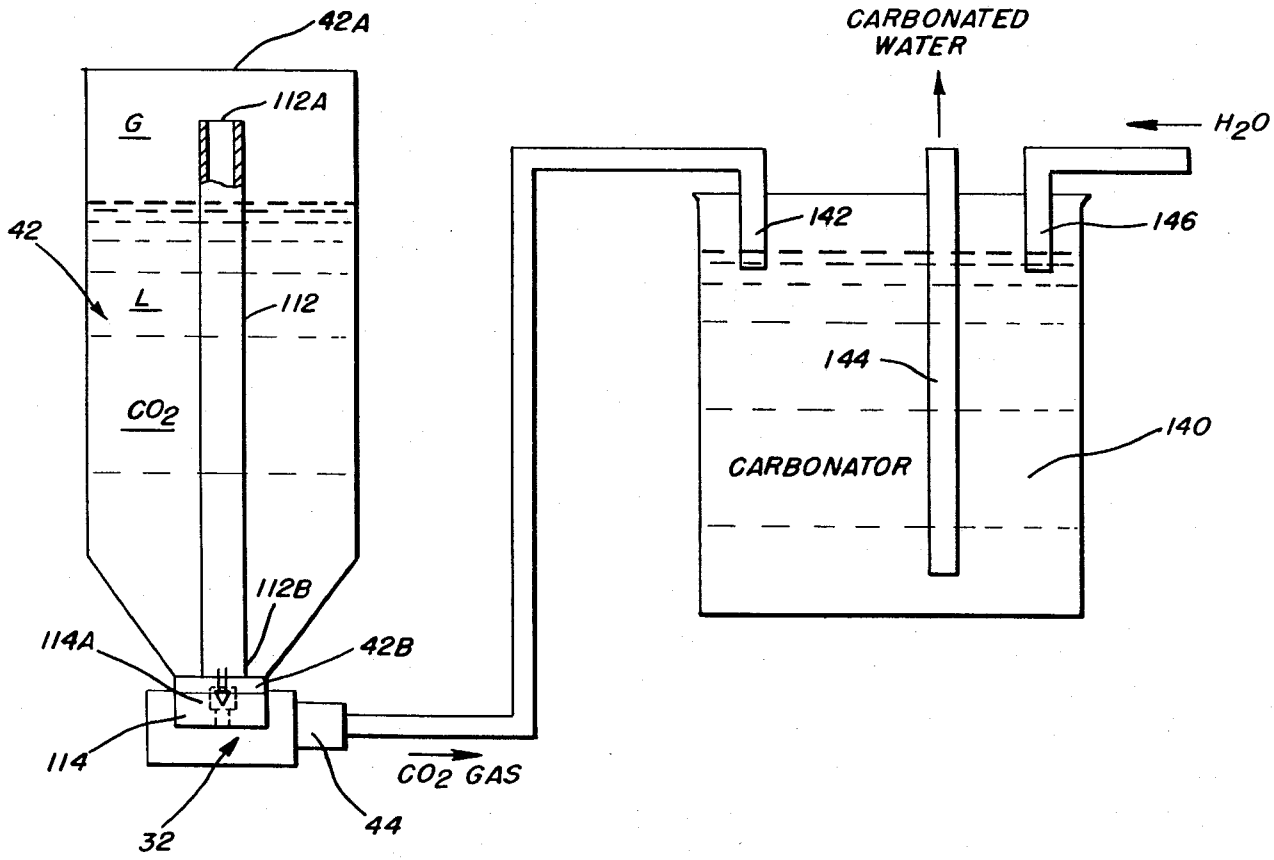
FIG. 4 is a diagrammatic view of the $CO_2$ cylinder structure, pressure regulator valve socket and carbonator system of applicant's copending U.S. Pat. No. 4,357,284 which is incorporated herein by reference.

Referring to FIG. 4, the $CO_2$ cylinder 42 to be used with the dispenser unit of the present invention is of the type described in the aforementioned Sedam U.S. Pat. No. 4,357,284, which has a dip tube therein to facilitate the dispensing of $CO_2$ gas from the container in an inverted position such as that which occurs when the discharge end is plugged into a socket in the top of $CO_2$ regulator valve assembly 44.

Referring in further detail to FIG. 4, there is illustrated a $CO_2$ cylinder generally indicated 42, which includes both liquid and gaseous $CO_2$ under a pressure of approximately 900 p.s.i.g. The cylinder 42 has an open end 42B defined by a narrow neck portion which is coupled to a plug-shaped extension 114, which plugs into an adaptor socket 32. Adaptor socket 32 supports the entire weight of the cylinder 10 and contains suitable resilient sealing means for sealing plug-shaped extension 114 therein. Plug-shaped extension 114 also contains a valve 114A therein which opens in response to the insertion of cylinder 42 into socket 32, providing a fluid path from cylinder 42 to a pressure regulator 44. Pressure regulator 44 is connected to the adaptor 32 and also to a $CO_2$ gas dispensing hose 142 running from the regulator to a carbonator tank 140. The carbonator tank may be of any conventional variety, and, of course, also includes a water inlet tube 146 and a carbonator water outlet tube 144.

The $CO_2$ cylinder 42 contains both a liquid phase L and a gaseous phase G which, because of their differences in weight, occupy different portions of the cylinder 42. That is, the gaseous phase G is at the top of the container, as illustrated adjacent the closed end 42A of the cylinder and the liquid phase L is disposed at the bottom thereof adjacent the open end 42B of the cylinder. An elongated tube 112, open at both ends 112A and 112B, is disposed within the cylinder, end 112B being supported within a socket of plug-shaped extension 114 and end 112A being disposed in spaced relation to the closed end 42A of the cylinder in communication with the gaseous phase G of the material therein. Extension 114 is inserted in the open end 42B of cylinder 42.

In operation, the $CO_2$ cylinders for use with the present invention may be quickly inserted and removed from the adaptor socket 32 simply by plugging them into or withdrawing them from adaptor socket 32. Because of the presence of elongated tube 112 within the interior of cylinder 42, the gaseous $CO_2$ in the head space adjacent closed end 42A of the cylinder, can be withdrawn through the tube, through the valve 114A and into the pressure regulator as soon as the valve is opened by the insertion of the cylinder into the socket 32.

As stated hereinbefore, if the cylinder 42 is inverted from the positions illustrated in the drawing, the liquid phase will move to the closed end of the container adjacent the open end of elongated tube 112 and only liquid can be withdrawn through the tube 112.

Thus, it can be seen, because of the novel construction of the $CO_2$ cylinder 42 of the present invention, including the elongated tube 112, that $CO_2$ supply cylinders may be quickly and efficiently replaced without the need for any threaded connections or special tools. Thus, when a particular $CO_2$ cylinder 42 becomes empty and needs replacement, an operator may simply pick up another cylinder and plug it into adaptor socket 32, which provides an instantaneous connection to the pressure regulator and carbonator tank.

I claim:

1. In a post-mix beverage dispenser system having a water supply, a carbonator tank, at least one syrup container, a $CO_2$ cylinder, a $CO_2$ pressure regulator valve assembly and a beverage dispenser valve assembly, the improvement comprising:

first socket means in said $CO_2$ pressure regulator valve assembly for receiving and supporting the discharge end and the weight of said $CO_2$ cylinder, said discharge end being at the bottom of said cylinder when said cylinder is disposed in said first socket means;

valve means operatively associated with the discharge end of said cylinder for initiating the discharge of $CO_2$ from said cylinder to said regulator valve assembly when open;

valve actuator means in said first socket means for opening said valve means in response to plugging of said discharge end of said $CO_2$ cylinder into said first socket means; and second socket means in said beverage dispenser valve assembly for receiving and supporting a discharge end and the weight of said syrup container, said discharge end of said syrup container being at the bottom of said container when said container is disposed in said second socket means, whereby said at least one syrup container and said at least one $CO_2$ cylinder can be rapidly plugged into said first and second socket means.

2. A method for loading syrup supply containers, and $CO_2$ supply containers into a post-mix beverage dispenser unit, said dispenser unit including first socket means in a $CO_2$ pressure regulator valve assembly for receiving and supporting the discharge end and the weight of a $CO_2$ cylinder and second socket means in a beverage dispenser valve assembly for receiving and supporting discharge ends and the weight of syrup containers, comprising the steps of:

providing syrup containers with discharge openings therein which are normally at the top of the container during storage and transportation;

providing a $CO_2$ container with an opening in a discharge end that is normally at the top of the container during storage and transportation;

inverting said syrup containers and plugging the discharge opening into said second socket means provided in the beverage dispenser valve assembly;

inverting said $CO_2$ container and plugging the discharge opening into said first socket means provided in the $CO_2$ regulator valve assembly; and opening a valve between the discharge opening of said $CO_2$ container and said regulator valve assembly to initiate the flow of $CO_2$ from said $CO_2$ cylinder to said regulator valve assembly in response to the plugging of the discharge opening of said $CO_2$ container into the first socket means in the regulator valve assembly.

3. The method of claim 2, further including the step of manually pouring water for the post-mix beverage into a water reservoir in said dispenser unit.

4. In a post-mix beverage dispenser system having a water supply, a carbonator tank, at least one syrup container, a $CO_2$ cylinder, a $CO_2$ pressure regulator valve assembly and a beverage dispenser valve assembly, the improvement comprising:

socket means in said $CO_2$ pressure regulator valve assembly for receiving and supporting the discharge end and the weight of said $CO_2$ cylinder, said discharge end being at the bottom of said container when said container is disposed in said socket means;

valve means operatively associated with the discharge end of said cylinder for initiating the discharge of $CO_2$ from said cylinder to said regulator valve assembly when open; and valve actuator means in said socket means for opening said valve means in response to plugging to said discharge end of said $CO_2$ cylinder into said socket means.

5. A method for loading $CO_2$ supply containers into a post-mix beverage dispenser unit, said dispenser unit including a socket in a $CO_2$ pressure regulator valve assembly for receiving and supporting the discharge end and the weight of a $CO_2$ cylinder, comprising the steps of:

providing a $CO_2$ container with a discharge opening in a discharge end that is normally at the top of the container during storage and transportation;

inverting said $CO_2$ container and plugging the discharge opening into said socket provided in the $CO_2$ regulator valve assembly; and opening a valve between the discharge opening of said $CO_2$ container and said regulator valve assembly to initiate the flow of $CO_2$ from said $CO_2$ cylinder to said regulator valve assembly in response to the plugging of the discharge opening of said $CO_2$ container into the socket in the regulator valve assembly.

6. The system of claim 1, wherein said $CO_2$ cylinder has a closed end opposite said discharge end and contains $CO_2$ therein in both a liquid and gaseous phase, and there is further provided elongated tube means extending from said discharge end of said cylinder to a point spaced from said closed end, said tube means providing a passage to said valve means through which only the gaseous phase of $CO_2$ in a region adjacent said closed end may be selectively dispensed from said cylinder.

7. The method of claim 2, wherein said $CO_2$ cylinder has a closed end opposite said discharge opening and contains $CO_2$ therein in both a liquid and gaseous phase, and there is further provided elongated tube means extending from said discharge opening of said cylinder to a point spaced from said closed end, said tube means providing a passage to said valve through which only the gaseous phase of $CO_2$ in a region adjacent said closed ends may be selectively dispensed from said cylinder.

8. The system of claim 4 wherein said $CO_2$ cylinder has a closed end opposite said discharge end and contains $CO_2$ therein in both a liquid and gaseous phase and there is further provided elongated tube means extending from said discharge end of said cylinder to a point spaced from said closed end, said tube means providing a passage to said valve means through which only the gaseous phase of $CO_2$ in a region adjacent said closed end may be selectively dispensed from said cylinder.

9. The method of claim 5 wherein said $CO_2$ cylinder has a closed end opposite said discharge opening and contains $CO_2$ therein in both a liquid and gaseous phase, and there is further provided elongated tube means extending from said discharge opening of said cylinder to a point spaced from said closed end, said tube means providing a passage to said valve through which only the gaseous phase of $CO_2$ in a region adjacent said closed end may be selectively dispensed from said cylinder.

* * * * *